US006194470B1

(12) United States Patent
Lutz et al.

(10) Patent No.: US 6,194,470 B1
(45) Date of Patent: Feb. 27, 2001

(54) SPARKLE LINEN SPRAY

(75) Inventors: Anita Lutz, Circleville, OH (US); Anthony Zembrodt, Covington, KY (US)

(73) Assignee: Bath & Body Works, Inc., Reynoldsburg, OH (US)

( * ) Notice: Subject to any disclaimer, the term of this patent is extended or adjusted under 35 U.S.C. 154(b) by 0 days.

(21) Appl. No.: 09/369,514

(22) Filed: Aug. 6, 1999

(51) Int. Cl.[7] ..... C09K 3/30; B05B 11/00; A61K 7/46

(52) U.S. Cl. ..... 516/7; 239/355; 239/360; 239/361; 512/1; 222/321.7

(58) Field of Search ..... 516/7, 76, 77; 424/76.1, 76.2; 106/31.02; 512/1, 2; 510/516; 359/296; 252/8.91; 239/355, 360, 361; 222/321.7, 630, 631, 634, 575; 428/542.2

(56) References Cited

U.S. PATENT DOCUMENTS

| | | | | |
|---|---|---|---|---|
| 55,008 | | 5/1866 | Gannett | 222/510 |
| 1,930,872 | | 10/1933 | Blackmun | 239/355 |
| 2,728,495 | | 12/1955 | Eaton | 222/192 |
| 3,004,718 | | 10/1961 | Gorman | 239/362 |
| 3,092,331 | | 6/1963 | Kiashek | 239/350 |
| 3,674,688 | * | 7/1972 | Schwartz et al. | 252/8.91 |
| 4,671,955 | * | 6/1987 | Palinczar | 424/47 |
| 4,915,935 | | 4/1990 | Corbett et al. | 424/47 |
| 5,614,489 | * | 3/1997 | Mohammadi et al. | 512/1 |
| 5,829,648 | | 11/1998 | Goeren et al. | 222/321.7 |
| 5,853,706 | * | 12/1998 | Klar | 424/70.1 |
| 6,007,846 | * | 12/1999 | Klar | 424/501 |
| 6,042,022 | * | 3/2000 | Rogozinski et al. | 239/211 |

* cited by examiner

*Primary Examiner*—Richard D. Lovering
*Assistant Examiner*—Daniel S. Metzmaier
(74) *Attorney, Agent, or Firm*—Colucci & Umans

(57) ABSTRACT

A sprayable composition in a pump spray bottle includes a fragrance oil and reflective material. The reflective material is sized to pass through the atomizer of the pump spray bottle. Linens or clothing can be sprayed with the composition to provide a pleasant smell and sparkling appearance to the surfaces sprayed.

13 Claims, 1 Drawing Sheet

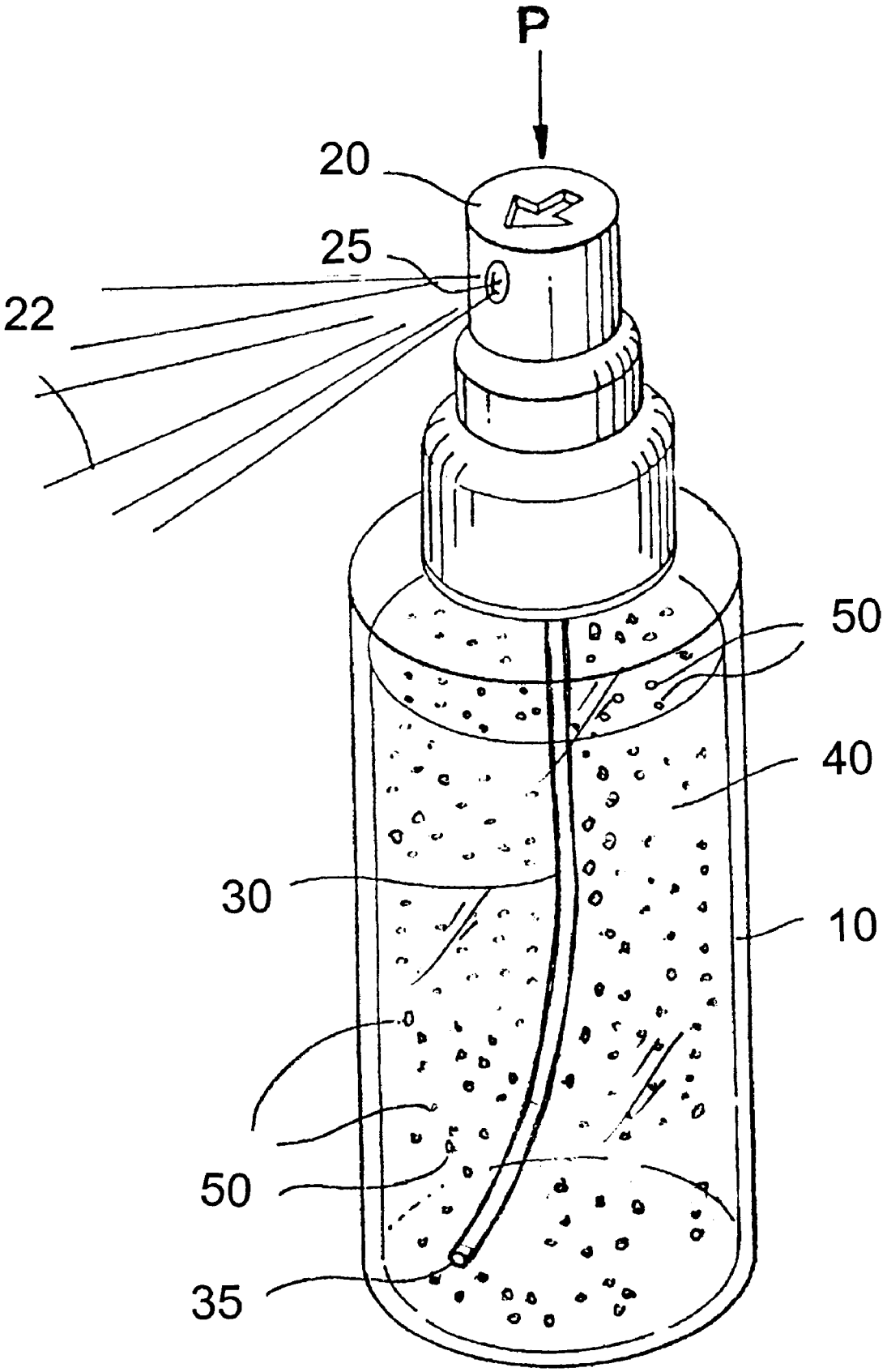
P
20
25
22
50
40
30
10
50
35

SPARKLE LINEN SPRAY

FIELD AND BACKGROUND OF THE INVENTION

The present invention relates generally to the field of home decorating and home fragrance and in particular to a new and useful composition for imparting a pleasant smell and appearance to linen, including sheets and pillowcases.

It is sometimes desirable to fragrance linens or clothes to provide a pleasant scent.

Glitter and other reflective material can be used to impart a fantastic look to surfaces on which it is sprinkled or scattered. In combination with lighting and fragrance, a romantic atmosphere can be created.

Glitter pieces can come in different shapes and sizes. One such shape is a regular hexagon. Typically the pieces of glitter are small, flat and reflective on at least one side. Dispersing glitter evenly and easily is difficult due to the fact that it is a solid and pieces often clump together. Due to its physical properties and composition, glitter does not form liquid solutions. When placed undissolved in a liquid, glitter will typically fall to the bottom of the container. Glitter can be suspended in a gel, but gels are usually not sprayable with an atomizer. Creating an even dispersion of glitter in a sprayable liquid is difficult to achieve.

Dispensing containers for liquid compositions are known in the art. U.S. Pat. No. 3,004,718 teaches a plastic spray bottle with a clear bottom portion. The liquid contents of the bottle can be seen in the clear bottom portion.

A perfume atomizer with a manually activated atomizing pump and opaque bottle is disclosed in U.S. Pat. No. 1,930,872. Perfume is dispensed from the bottle when the pump head is depressed.

U.S. Pat. No. 2,728,495 is for a container with an atomizer which uses pressure provided by a chloro-fluorocarbon (CFC), such as FREON, to forcibly expel the contents of the container.

Air freshener and clothes freshening compositions are known in the art as well. For example, U.S. Pat. No. 55,008 teaches a clothes sprinkler for dispensing water on clothes while they are being ironed. The container can be shaken to release water, but will not leak when laid down.

U.S. Pat. No. 3,092,331 discloses a scent sprayer having a pad in the pump cylinder for preventing the liquid being sprayed from dripping out the sprayer opening.

A composition containing reflective particles for use in personal grooming is disclosed by U.S. Pat. No. 4,915,935. The composition is a fast-breaking foam containing glitter for use in a person's hair. The composition is dispensed under pressure from an aerosol container.

U.S. Pat. No. 5,829,648 discloses an air freshening apparatus and method which, in addition to affecting the aroma of household areas and materials, such as bedding, also has an advantageous psychological affect. A recently emerging field known as "Aromatherapy", explores the beneficial psychological, and resulting physical advantages which may be achieved by exposing an individual to pleasant aromas and mixtures of aromas. The apparatus of U.S. Pat. No. 5,829,648 comprises a container, a liquid containing a scent in the container, spray means connected to the container for spraying the liquid from the container and at least one hard bead in the container, the bead being non-soluble in the liquid and being dimensioned so that the bead bounces against interior walls of the container when the container is shaken by the user, to generate sounds and vibrations which are sensed by the user, and which, with the aroma also sensed by the user, entertains the user.

None of the compositions known in the art are clear or colored transparent fragranced liquids with a reflective material that can be sprayed from a pump activated atomizer.

SUMMARY OF THE INVENTION

It is an object of the present invention to provide a fragrant composition having a novel appearance when dispensed on linens.

Accordingly, a sprayable composition having a fragrance oil and a sparkling component are provided in a pump spray bottle. The sparkling component is a glitter sized to pass through a dip tube and atomizer of the pump spray bottle. The fragrance oil and glitter are dispersed in a clear mixture of suspending agent, a non-ionic surfactant to solubulize the fragrance oil, a clarifying agent, propylene glycol, 200 proof denatured ethyl alcohol and deionized water and a pH balancer.

Advantageously, the pump spray bottle is clear, so that the contents of the bottle can be observed before use. The composition is clear, or colored transparent with the glitter suspended and has a pleasant appearance. In use, the composition can be sprayed on linens in a fine mist, leaving a sparkling appearance and pleasant smell.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only drawing is a perspective view of a pump spray bottle containing the composition of the invention.

DESCRIPTION OF THE PREFERRED EMBODIMENTS

Referring now to the drawing, the figure shows a pump spray bottle 10 having an atomizer 20 and dip tube 30. The dip tube 30 extends into a liquid linen spray composition 40 contained in the bottle 10. The linen spray composition 40 in the bottle includes a plurality of pieces of reflective material 50 dispersed throughout the linen spray 40. The reflective material 50 is sized to pass through the opening 35 of the dip tube 30 and out the atomizer outlet 25. Thus, when the atomizer 20 is pumped, as indicated by arrow P, spray 22 is generated which consists of linen spray 40 with pieces of reflective material 50. The spray 22 is preferably a fine mist.

The atomizer 20 and dip tube 30 may be of any type commonly known for use in dispensing liquids, provided they are sized appropriately to permit the reflective material 50 to pass therethrough.

Bottle 10 is preferably a clear plastic container, so that the contents of the bottle 10 can be seen prior to use.

The linen spray composition 40 in the bottle 10 is a fragrant liquid mixture having reflective material 50 dispersed throughout the liquid mixture. The liquid linen spray mixture 40 is preferably either clear or colored transparent. That is, the liquid may be tinted, but objects can still be seen through the liquid.

The linen spray liquid is composed of fragrance oil, a suspending agent, witch hazel distillate containing 0.15% benzoic acid, propylene glycol, a nonionic surfactant, a 200 proof denatured ethyl alcohol and deionized water. The reflective material is suspended in the fragrant liquid. Triethanolamine (TEA) is used to adjust the pH of the solution. One example of an acceptable formulation is provided below.

EXAMPLE

The following ingredients (expressed in terms of percent by weight) are combined to make 100 g of a raspberry-scented version of the liquid mixture as described below:

| Component | Amount (wt %) |
|---|---|
| Deionized Water | 56.644 |
| 0.25% wt/wt solution CARBOPOL 941 polymer (suspending agent) | 19.490 |
| Propylene Glycol | 1.715 |
| Witch Hazel containing 0.15% Benzoic Acid | 5.068 |
| TRITON X-100 (non-ionic surfactant) | 0.845 |
| Raspberry Fragrance (fragrance oil) | 0.845 |
| SD Alcohol 39-C (denatured ethyl alcohol - 200 Proof) | 15.207 |
| 10% TEA solution | 0.076 |
| Glitter | 0.110 |

To prepare the liquid mixture, first the deionized water, 0.25% solution of CARBOPOL 941 polymer (a suspending agent made by B. F. Goodrich) and water, propylene glycol and witch hazel distillate containing 0.15% benzoic acid are combined and then mixed in a beaker on a stir plate.

The TRITON X-100, a non-ionic surfactant from Union Carbide, and raspberry fragrance are mixed together to solubulize the fragrance oil. The solubilized fragrance oil is then combined with the components in the beaker on the stir plate. The contents of the beaker are mixed to a homogenous solution.

Next, the glitter is mixed into the SD Alcohol 39-C (from Remet), and then the combined glitter and alcohol is added to the beaker and mixed for 3–5 minutes to form a uniform liquid. The glitter being used should be of a small enough diameter to fit through the dip tube and atomizer outlets of the intended pump spray container. A preferred glitter size is 0.008 inch hexagonal diameter. A suitable atomizer and dip tube assembly is one from CALMAR having a "standard" dip tube diameter and VH 23 atomizer outlet size. A preferred length for the dip tube is about 4¾ inches long in a similarly sized bottle. The dip tube length should be selected to fit the bottle or container used to hold the sprayable mixture.

A pH meter can be used to measure the pH as drops of TEA are added. While mixing on the stirplate, the 10% TEA solution is added dropwise until the pH is between 6.7 and 7.0.

Once the mixture has the proper pH, it can be poured into a pump spray bottle of suitable dimensions for dispensing.

Other glitter sizes and shapes may be used, provided the atomizer opening and dip tube diameter are selected to permit the glitter to pass when the atomizer is pumped.

The liquid composition of the invention suspends the glitter so that it can be sprayed through the atomizer in a fine mist. The liquid is sufficiently non-viscous that it can be sprayed through the pump atomizer 20 and dip tube 30.

The CARBOPOL 941 polymer solution acts as a suspending agent. Preferably, the CARBOPOL 941 polymer is used as a 0.25% solution in water, although other percentage solutions are possible and work equally well. CARBOPOL 941 polymer is a high molecular weight crosslinked homopolymer and copolymer of acrylic acid.

Witch hazel distillate is a clarifying agent to improve the transparency of the solution. Alcohol or a suitable surfactant could be used in place of the witch hazel as a clarifying agent.

Propylene glycol is a diol used as a bridge builder between the water and oil phases of the mixture. The propylene glycol acts as a solvent for other components of the mixture. Other diols with similar properties could be substituted for propylene glycol.

The non-ionic surfactant is selected to solubilize the fragrance oil. TRITON X-100 is one such surfactant, having an HLB (hydrophobic/lipophilic balance) value of 13.5. It is possible to substitute other surfactants having a similar HLB value and which solubilizes the fragrance oil for mixing with the other spray components to form a homogenous solution. Suitable surfactants include ethoxylated alcohols, ethoxylated alkyphenols and block co-polymers having HLB values above 11, and preferably, about 13.5.

The SD Alcohol 39-C acts as a solvent in the solution and decreases the drying time of the spray. Other alcohols, such as I.P.A. (isopropyl alcohol), including other denatured ethyl alcohols, can be substituted, depending on how rapidly the spray needs to dry and/or the solubility requirements of the particular formulation of the spray composition.

Suitable ranges for each of the ingredients making up the liquid are shown in the table below:

| Component | Range (wt %) |
|---|---|
| Deionized Water | 40–65 |
| 0.25% solution CARBOPOL 941 polymer (suspending agent) | 15–25 |
| Propylene Glycol | 1–3 |
| Witch Hazel Distillate (clarifying agent) | 2.5–7.5 |
| TRITON X-100 (non-ionic surfactant) | 0.5–1.5 |
| fragrance oil | 0.5–1.5 |
| SD Alcohol 39-C (200 Proof) | 10–20 |
| 10% TEA solution | q.s. |
| glitter | 0.005–1.00 |

The fragrance oil could be any known fragrance, and may be selected for a particular potency or scent. As noted above, the amount of fragrance is preferably between 0.5% and 1.5% by weight, but can be outside this range if needed to provide a suitably strong scent. The composition of the solution may be adjusted to accommodate different fragrance oils used with the invention.

It should be noted that the clarifying agent could be a surfactant. Alternatively, the same clarifying effect can be obtained using more alcohol.

The spray of the invention provides a liquid carrier for glitter. The glitter is suspended in and evenly dispersed throughout the liquid. The liquid and glitter are sprayable and can be dispensed from a spray pump atomizer in a fine mist to impart both a pleasant scent and appearance to linens, clothing and other surfaces.

While a specific embodiment of the invention has been shown and described in detail to illustrate the application of the principles of the invention, it will be understood that the invention may be embodied otherwise without departing from such principles.

What is claimed is:

1. A liquid composition for providing a sparkling appearance to a surface sprayed with the liquid composition, the liquid composition comprising:

a homogenous solution formed from:

40–65% by weight of deionized water; 15–25% by weight of a 0.25% by weight of a polymeric suspending agent solution; 2.5–7.5% by weight of a clarifying agent; 0.5–1.5% by weight of a non-ionic surfactant having an HLB value greater than 11; 10–20% by weight of a denatured ethyl alcohol; 1–3% by weight of propylene glycol; and a fragrance oil; and a reflective material suspended in and dispersed throughout the homogenous solution.

2. A liquid composition according to claim 1, wherein the clarifying agent is witch hazel distillate that contains 0.15% by weight benzoic acid.

3. A liquid composition according to claim 1, wherein the reflective material is glitter.

4. A liquid composition according to claim 3, wherein the glitter is 0.008 inch hexagonal diameter glitter.

5. A liquid composition according to claim 3, wherein the nonionic surfactant has having an HLB value greater than 13.5.

6. A liquid composition according to claim 3, wherein the nonionic surfactant is selected from the group consisting of ethoxylated alcohols, ethoxylated alkylphenols and block copolymers.

7. A liquid composition according to claim 1, wherein the reflective material comprises 0.005–1% by weight of the homogenous solution.

8. A sparkling spray comprising:

a transparent container having a pump atomizer and a dip tube;

a liquid spray in the transparent container; the aqueous liquid spray being homogeneous and comprising 15–25% by weight of a polymeric suspending agent solution, 2.5–7.5% by weight of a clarifying agent, 0.5–1.5% by weight of a nonionic surfactant having an HLB value greater than 11, a fragrance oil, and 0.005–1.0% by weight of a reflective material;

wherein the liquid spray being sufficiently non-viscous to dispense through the dip tube and pump atomizer; and wherein the reflective material is suspended in and dispersed throughout the liquid spray and sized for dispensing with the liquid spray through the pump atomizer.

9. A sparkling spray according to claim 8, wherein the liquid spray is transparent, such that the reflective material is visible suspended in the liquid.

10. A sparkling spray according to claim 8, wherein the nonionic surfactant has having an HLB value greater than 13.5.

11. A sparkling spray according to claim 8, wherein the reflective material is glitter having hexagonal diameter of 0.008 inch.

12. A sparkling spray according to claim 11, wherein the liquid spray comprises 40–65% by weight of deionized water; 15–25% by weight of a 0.25% by weight polymeric suspending agent solution; 2.5–7.5% by weight of a clarifying agent; 0.5–1.5% by weight of a nonionic surfactant having an HLB value greater than 11; 10–20% by weight of a denatured ethyl alcohol; 1–3% by weight of propylene glycol; and a fragrance oil.

13. A sparkling spray according to claim 12, wherein the nonionic surfactant is selected from the group consisting of ethoxylated alcohols, ethoxylated alkylphenols and block copolymers.

* * * * *